US011906276B2

(12) United States Patent
McLeod

(10) Patent No.: US 11,906,276 B2
(45) Date of Patent: Feb. 20, 2024

(54) WAD FOR A SHOTGUN CARTRIDGE

(71) Applicant: Graham Richard McLeod, Devon (GB)

(72) Inventor: Graham Richard McLeod, Devon (GB)

( * ) Notice: Subject to any disclaimer, the term of this patent is extended or adjusted under 35 U.S.C. 154(b) by 0 days.

(21) Appl. No.: 17/636,001

(22) PCT Filed: Sep. 2, 2020

(86) PCT No.: PCT/GB2020/052099
§ 371 (c)(1),
(2) Date: Feb. 16, 2022

(87) PCT Pub. No.: WO2021/044139
PCT Pub. Date: Mar. 11, 2021

(65) Prior Publication Data

US 2022/0282959 A1 Sep. 8, 2022

(30) Foreign Application Priority Data

Sep. 5, 2019 (GB) ..... 1912778
May 21, 2020 (GB) ..... 2007625

(51) Int. Cl.
*F42B 7/08* (2006.01)

(52) U.S. Cl.
CPC ..... *F42B 7/08* (2013.01)

(58) Field of Classification Search
CPC ..... F42B 7/08; F42B 7/06; F42B 7/043
USPC ..... 102/451, 448, 449, 450, 453, 454, 455, 102/457, 459, 460, 532
See application file for complete search history.

(56) References Cited

U.S. PATENT DOCUMENTS 1,735,639 A 11/1929 Densten
2,026,765 A * 1/1936 Woodford ..... D21J 3/00 102/532
2,959,130 A * 11/1960 Weiss ..... F42B 5/38 102/532
2001/0042486 A1 11/2001 Dales
2013/0055917 A1* 3/2013 Menefee, III ..... F42B 7/10 102/370
2013/0228090 A1* 9/2013 Billings ..... F42B 7/08 264/250
2021/0140747 A1* 5/2021 McDevitt ..... F42B 33/0207
(Continued)

FOREIGN PATENT DOCUMENTS

DE 4016826 A1 11/1991
GB 2343939 A 5/2000
(Continued)

OTHER PUBLICATIONS

International Search Report and the Written Opinion of the International Searching Authority, or the Declaration, dated Nov. 13, 2020, PCT/GB2020/052099, 9 pages.
(Continued)

*Primary Examiner* — John Cooper

(57) ABSTRACT

A wad (4, 9) for a shotgun cartridge (20) is described. The wad (4, 9) comprises a cup-shaped member (4) and a separation member (9) located inside the cup-shaped member (4) adjacent a base of the cup-shaped member (4). The cup-shaped member (4) and the separation member (9) each comprise at least one biodegradable fibrous material.

18 Claims, 12 Drawing Sheets

(56) References Cited

U.S. PATENT DOCUMENTS

2021/0270586 A1* 9/2021 Maricaille ..... F42B 7/08

FOREIGN PATENT DOCUMENTS

| | | | |
|---|---|---|---|
| WO | 199105982 | A1 | 5/1991 |
| WO | 200244644 | A2 | 6/2002 |

OTHER PUBLICATIONS

Patents Act 1977: Search Report under Section 17, GB Application No. 1912778.6, dated Feb. 24, 2020, 1 page.
Patents Act 1977: Search Report under Section 17, GB Application No. 2007625.3, dated Sep. 30, 2020, 1 page.

* cited by examiner

WAD FOR A SHOTGUN CARTRIDGE

CROSS-REFERENCE TO RELATED APPLICATION

This application is a 371 of PCT/GB2020/052099 filed Sep. 2, 2020 which claims priority to GB application No. 2007625.3 filed May 21, 2020 and GB application No. 1912778.6 filed Sep. 5, 2019.

BACKGROUND OF THE INVENTION

The invention relates to a wad for a shotgun cartridge.

Generally, a shotgun cartridge is composed of five components, namely: a primer, gun powder, a wad, shot and a case. Modern cases are usually made of plastic and have a brass head at one end. The other end is closed by crimping the end of the plastic so that it folds down onto itself to close the case. This closure is widely referred to as a folded crimp. Located within the case are the other four components. The primer which is located in the centre of the brass head of the cartridge. Above the primer and inside the brass head is located the gun powder. Above the gun powder is a wad which is usually made of fibre or plastic and creates a seal within the cartridge so that explosive gases generated by ignition of the powder do not dissipate and the full pressure of the gases builds up below the wad to propel the wad and shot out of the cartridge with the maximum force. The wad also creates a wall between the shot and the powder so that they don't mix. The shot is made of a number of small round metal pellets. These were traditionally lead pellets but now non-lead alternatives are also used.

When the primer is hit by the firing pin of the shotgun, this creates a chemical reaction in the primer which produces heat. This heat then ignites the gun powder. Ignition of the powder creates explosive gases which in turn create the required pressure to propel the wad and shot forwards out of the cartridge case and to exit the barrel of the shotgun towards the target. Generally, due to air resistance on the wad and the relatively light weight of the wad, the wad will separate from the shot and while the shot continues to head towards the target, the wad will fall to the ground some distance from the where the gun is fired. This is typically around 20 to 40 metres from where the gun is fired.

Nowadays, most wads are plastic and are typically, in the form of a plastic cup within which the shot is held in the cartridge. Therefore, when the shotgun is fired, both the plastic wad and the shot is propelled out of the barrel of the shotgun. Although the cases of used cartridges can be collected after they are removed from the breach of the shotgun, it is difficult or impossible to collect the plastic wads as they maybe propelled out of the shotgun for around 20 to 40 metres and frequently end up falling in the undergrowth or wooded areas where they are difficult or impossible to find. Accordingly, there is an increasing concern about the environmental impact of plastic wads left lying around the countryside.

BRIEF SUMMARY OF THE INVENTION

In accordance with a first aspect of the present invention, there is provided a wad for a shotgun cartridge, the wad comprising a cup-shaped member having an open end and closed end, and wherein the cup-shaped member comprises a first biodegradable fibrous material.

Preferably, the wad further comprises a separation member located inside the cup-shaped member adjacent the closed end of the cup shaped member, and the separation member comprises a second biodegradable fibrous material.

The first and second biodegradable fibrous materials may be the same or may be different.

Preferably, at least one of the first and second biodegradable fibrous materials is a natural fibrous material and more preferably is a natural organic fibrous material.

Typically, at least one of the first and second biodegradable fibrous materials is formed from at least one of a cellulose based fibrous material and a protein based fibrous material.

In one example, the cup-shaped member is formed from a cellulose based fibrous material that may be plant based or wood based.

Preferably, at least one of the cup-shaped member and the separation member are formed at least in part from a pulp material, and more preferably at least one of the cup-shaped member and the separation member are formed at least in part from card or cardboard.

Alternatively, at least one of the cup-shaped member and the separation member are formed at least in part from a felt material. For example, the felt material may be formed from one or more of wool, hair, fur and cellulose fibres.

Typically, where the at least one of the first and second biodegradable fibrous materials comprises a protein based fibrous material, the protein based fibrous material may comprise at least one of wool, hair and fur.

Preferably, the cup-shaped member may comprise a fabric material. The fabric material may be woven or knitted but is preferably, woven.

The fabric material is typically formed from a biodegradable material, which is preferably a naturally occurring material. For example, the fabric material may be formed from a plant-based fibrous material or from a protein-based fibrous material. Protein-based fibrous materials typically come from animals, such as mammals or insects. The fabric material could be formed from combinations of different plant-based fibrous materials, combinations of different protein-based materials or combinations of different plant-based and protein-based fibrous materials. Examples of plant-based fibrous materials for the fabric material include cotton, hemp, flax and jute. Examples of protein-based fibrous materials for the fabric material include wool, silk and hair.

The cup-shaped member preferably comprises the fabric material and at least one other material. The other material may be, for example, a material formed from a pulp, such as card. The fabric material may be incorporated into the cup-shaped member, such as, by being laminated onto the at least one other material. For example, the fabric material may be incorporated into the cup-shaped member by being laminated onto the at least one other material such that it forms an outer layer of the cup-shaped member on the outside or inside of the cup-shaped member or laminated between layers of the at least one other material so that it is within a side wall of the cup-shaped member.

Alternatively, the fabric material may be incorporated into the cup-shaped member by being entrapped or embedded within the at least one other material. This may be during a manufacturing process, for example, during a molding process.

In a further alternative, the cup-shaped member may comprise a number of layers of fabric material and a number of layers of at least one other material with at least one of the layers of the at least one other material having a fabric material entrapped or embedded within it.

The fabric material may be incorporated into only a section of the cup-shaped member or may extend throughout the cup-shaped member. Preferably, the fabric material extends completely around a side wall of the cup-shaped member. Preferably, the fabric material extends along the full length of the cup-shaped member.

An advantage of the cup-shaped member comprising a fabric material is that the fabric material assists in improving the structural strength of the cup-shaped member. This reduces the risk of the cup-shaped member disintegrating when a shotgun cartridge including the wad is fired from a gun.

The separation member may be formed from a compressed fibrous material. The compressed fibrous material may be a compressed protein based fibrous material, such as wool, hair or fur. In one example, the fibrous material could be in the form of a felt, such as a felt formed from one or more of wool, hair, fur and cellulose fibre. Alternatively, the compressed fibrous material may be a compressed cellulose based fibrous material, such as cotton or flax or a compressed pulp material.

Preferably, the cup-shaped member comprises a tubular member having a closed end forming the base and an open end.

Preferably, the tubular member is crimped at one end to form the closed end. More preferably, the crimped closed end comprises a folded crimp. The folded crimp may be a six star folded crimp or an eight star folded crimp.

Typically, the tubular member has substantially cylindrical side-walls extending between the closed end and the open end.

In one example, a side wall of the cup-shaped member may have at least one slit extending from adjacent the open end to at least part way along the side wall towards the closed end.

Preferably, the at least one slit is open at the open end. In one example, opposite sides of the at least one slit are spaced apart from each other so that the slit forms a slot.

Typically, the end of the at least one slit closest to the closed end is spaced from the closed end.

Preferably, the cup-shaped member comprises a friction reducing outer surface. More preferably, the friction reducing outer surface comprises a coating. The coating may comprise a resin material. Preferably, the coating may be biodegradable. The coating may be water soluble.

Typically, the separation member is adapted to separate the closed end of the cup-shaped member from a projectile located adjacent the open end of the cup-shaped member, in use.

In one example, the separation member may be in the form of a plug or disc that is typically solid. Preferably, the separation member is substantially cylindrical and more preferably a solid cylinder.

Preferably, the separation member extends across substantially all of the internal cross-sectional area of the cup-shaped member adjacent the closed end of the cup-shaped member. The separation member may be a friction fit in the cup-shaped member.

An advantage of the separation member is that it helps to provide additional structural strength or support to the cup-shaped member, particularly at the closed end of the cup-shaped member. The separation member also acts as a barrier between the closed end and the projectile located in the cup-shaped member above the separation member. The separation member can also provide some shock absorption between gun powder in the cartridge and the projectile.

In accordance with a second aspect of the present invention, there is provided a shotgun cartridge comprising an outer casing, the casing containing a primer located in a base of the casing, an explosive powder adjacent the base of the casing and the primer, a wad comprising a cup-shaped member located on the opposite side of the powder from the base and a projectile located within the cup-shaped member; and wherein the cup-shaped member comprises a first biodegradable fibrous material.

Preferably, the wad further comprises a separation member located within the cup-shaped member which may comprise a second biodegradable fibrous material. More preferably, the separation member is located between a closed end of the cup-shaped member and the projectile.

Preferably, the cup-shaped member comprises a tubular member having a crimped closure at one end. More preferably, the crimped closure is a folded crimped closure.

The wad may further comprise a barrier member located between the explosive powder and the cup-shaped member. The barrier member may be in the form of a disc.

Preferably the barrier member extends across substantially all of the internal cross-sectional area of the casing to minimise contact between the powder and the cup-shaped member. Therefore, the barrier member acts to substantially isolate the powder from the cup-shaped member.

In one example, the cup-shaped member comprises at least one slit extending from adjacent an open end of the cup-shaped member at least part way along the side wall towards the closed end.

The shotgun cartridge of the second aspect may comprise a wad having any of the features of the first aspect of the invention.

Typically, the projectile is metal shot, such as lead shot. However, other projectiles could be used.

BRIEF DESCRIPTION OF THE SEVERAL VIEWS OF THE DRAWINGS

Examples of a wad for a shotgun cartridge in accordance with the invention will now be described with reference to the accompanying drawings, in which.

DETAILED DESCRIPTION OF THE INVENTION

Figure 1:
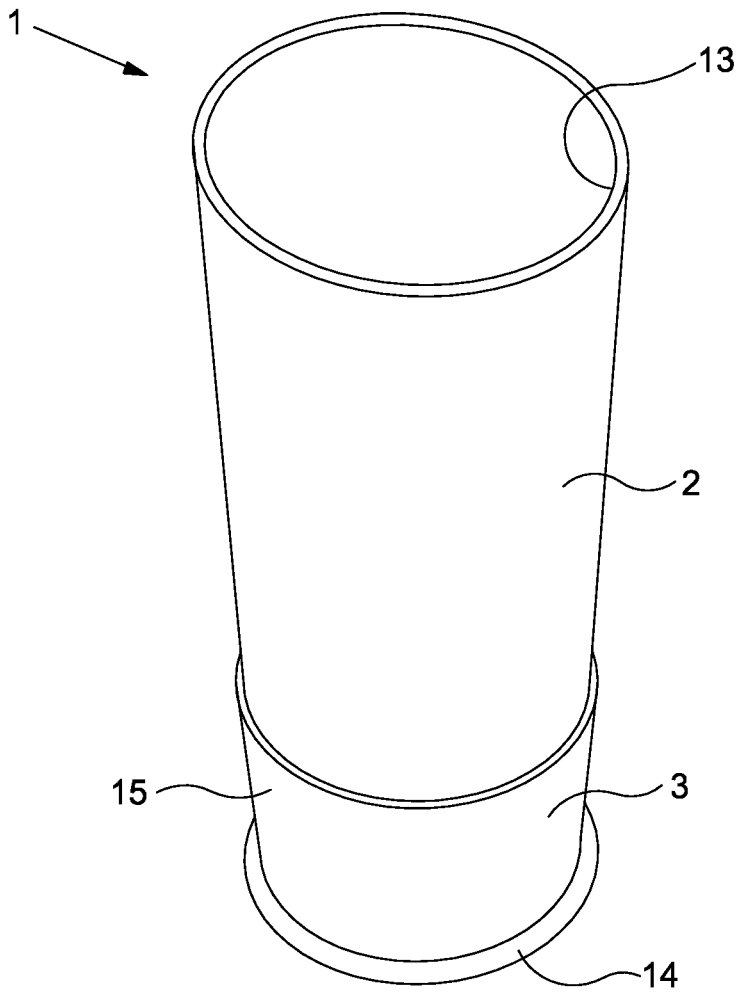
FIG. 1 is a perspective view of a case for a shotgun cartridge.

FIG. 1 shows a case 1 for a shotgun cartridge. The case 1 comprises a plastic sleeve 2 and a metal head 3 that is typically formed from brass. The metal head 3 has a base 14 and a side wall 15 into which one end of the plastic sleeve 2 fits. Hence, one end of the plastic sleeve is effectively closed by the head 3. The opposite end 13 of the plastic sleeve is open.

Figure 2:
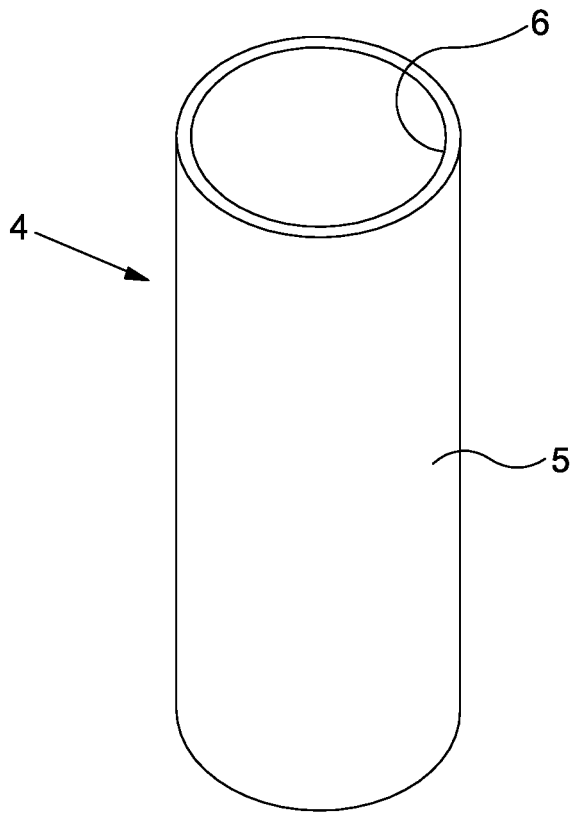
FIG. 2 is a perspective view of a first example of a cup section of a wad according to the invention for a shotgun cartridge.
Figure 3:
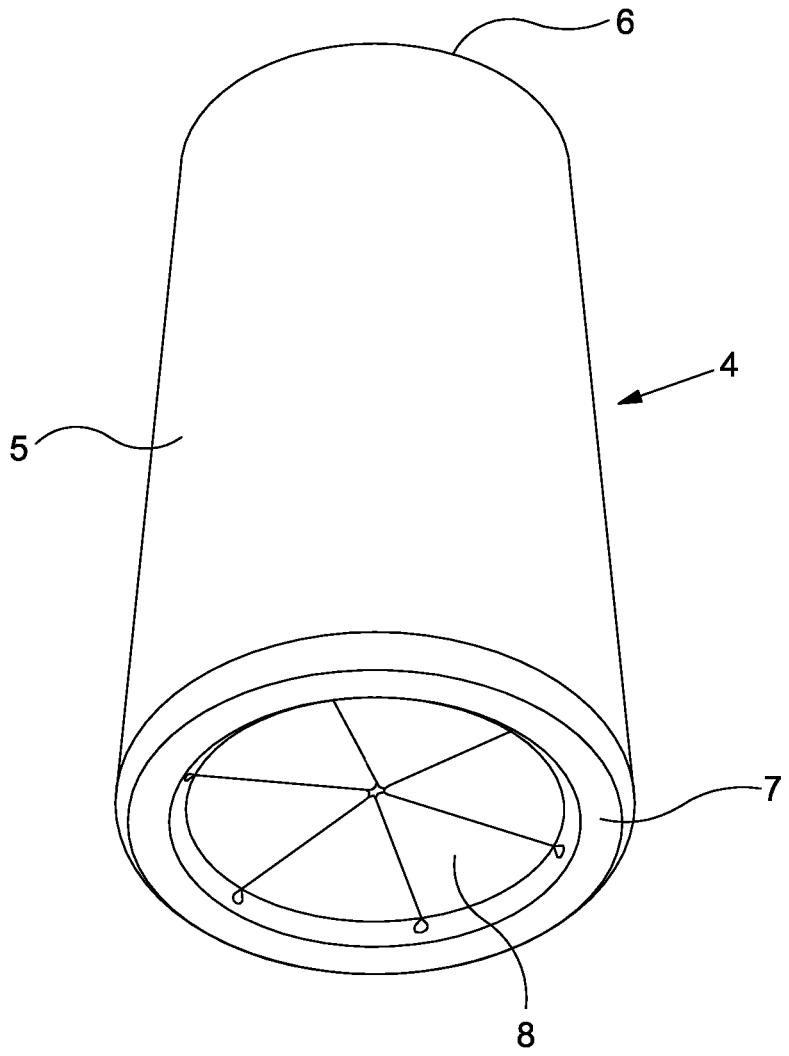
FIG. 3 is a perspective view from below of the cup section.

FIGS. 2 and 3 show a cup section 4 of a wad in accordance with the invention. The cup section 4 is formed from wood pulp, and for example, maybe card or cardboard. However, the cup section 4 could be formed from any suitable biodegradable material, and preferably a biodegradable fibrous material.

The biodegradable material may be composed of natural (as opposed to synthetic or man-made) materials, such as natural fibres. For example, the biodegradable material may comprise at least one of a cellulose based fibrous material and a protein based fibrous material. Examples of cellulose based fibrous materials include cotton, flax and cardboard. Examples of protein based fibrous materials include wool, hair, fur and silk. Cellulose based fibrous materials may be formed from a pulp, such as a wood-based or a plant-based pulp. The biodegradable fibrous material may be a compressed fibrous material, such as compressed cellulose based fibres (such as cotton fibres, flax fibres, wood-based pulp or plant based pulp) and/or compressed protein based fibres (such as wool, fur or hair). In one example, the biodegradable fibrous material could be formed from a felt material.

The cup section 4 is in the form of a cylindrical tube 5 having an open end 6 and a closed end 7. The closed end 7 is typically closed by crimping the end of the cylinder 5 to form a folded crimp 8 at the closed end 7 of the tube 5. In the example shown, the folded crimp 8 is a six star folded crimp. However, any suitable or desirable folded crimp could be used, such as an eight star folded crimp.

An advantage of using a folded crimp to form the closed end 7 is that a folded crimp adds structural strength to the closed end of the cup section 4.

The outside surface of the cup section 4 has a friction reducing surface. The friction reducing surface maybe an inherent part of the material from which the cup section 4 is formed or maybe a coating applied to the external surface of the cup section 4. For example, the coating may comprise a varnish, which may comprise a resin, and the varnish cures to form the coating on the external surface of the cup section 4. The coating may be water soluble.

Figure 4:
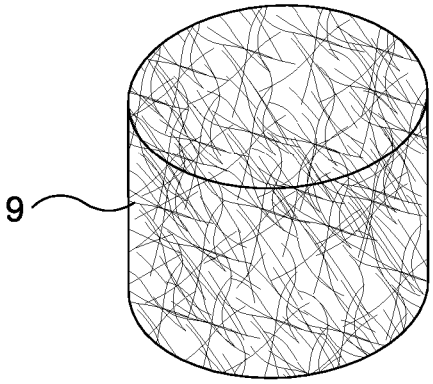
FIG. 4 is a perspective view of a separation member of the wad in accordance with the invention.

FIG. 4 shows a separation member 9 in the form of a solid cylinder. The separation member 9 is formed from any suitable biodegradable material, and preferably a biodegradable fibrous material. The biodegradable material may be composed of natural (as opposed to synthetic or man-made) materials, such as natural fibres. For example, the biodegradable material may comprise at least one of a cellulose based fibrous material and a protein based fibrous material. Examples of cellulose based fibrous materials include cotton, flax and cardboard. Examples of protein based fibrous materials include wool, hair, fur and silk. Cellulose based fibrous materials may be formed from a pulp, such as a wood-based or a plant-based pulp. The biodegradable fibrous material may be a compressed fibrous material, such as compressed cellulose based fibres (such as cotton fibres, flax fibres, wood-based pulp or plant based pulp) and/or compressed protein based fibres (such as wool, fur or hair). In one example, the biodegradable fibrous material could be formed from a felt material.

Figure 5:
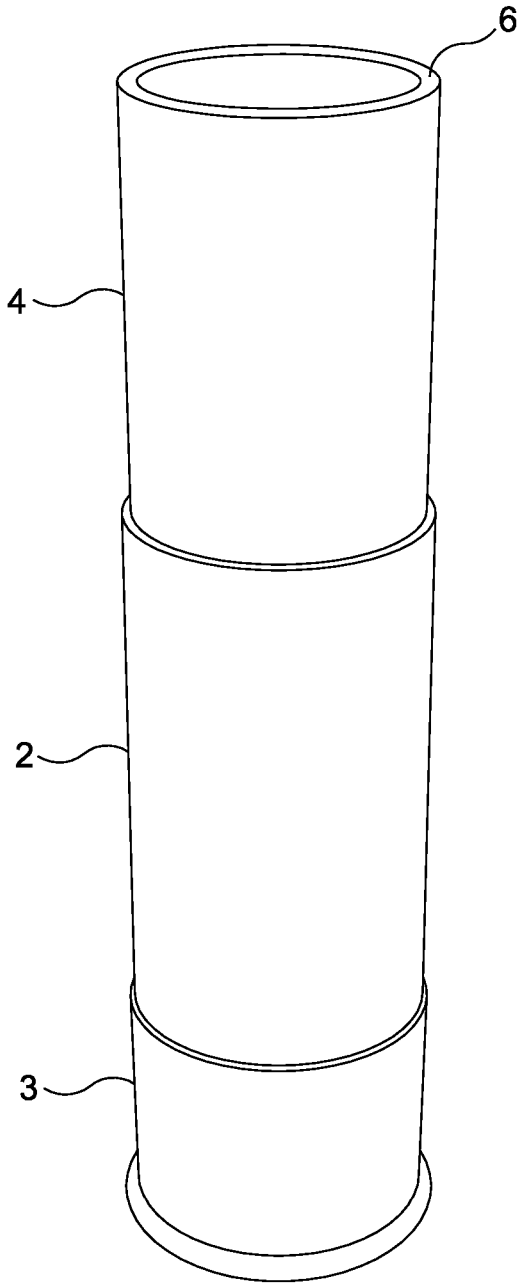
FIG. 5 is a perspective view of the first example of the cup section being inserted into the case of FIG. 1.
Figure 6:
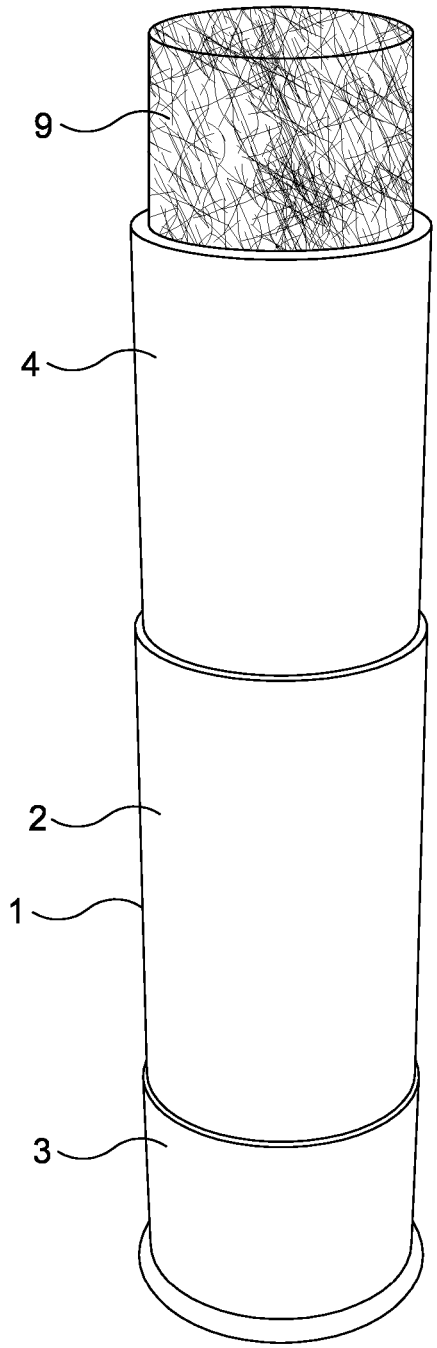
FIG. 6 is a perspective view of the separation member being inserted into the first example of the cup section of the wad.

The cup section 4 is configured so that the external diameter of the cylindrical tube is the same as or slightly less than the internal diameter of the plastic sleeve 2. This enables the cup section 4 to fit inside the sleeve 2, as shown in FIG. 5. The separation member 9 is configured so that its external diameter is the same as or slightly less than the internal diameter of the cylindrical sleeve 5. This enables the separation member 9 to fit inside the cup section 4, as shown in FIG. 6. The separation member is pushed down inside the cup section 4 so that the separation member 9 is located at the bottom of the cup section 4 adjacent the closed end 7. The separation member 9 effectively forms a plug at the closed end 7 of the cup section 4. The separation member 9 is typically a push fit or friction fit inside the cup section 4.

Figure 7:
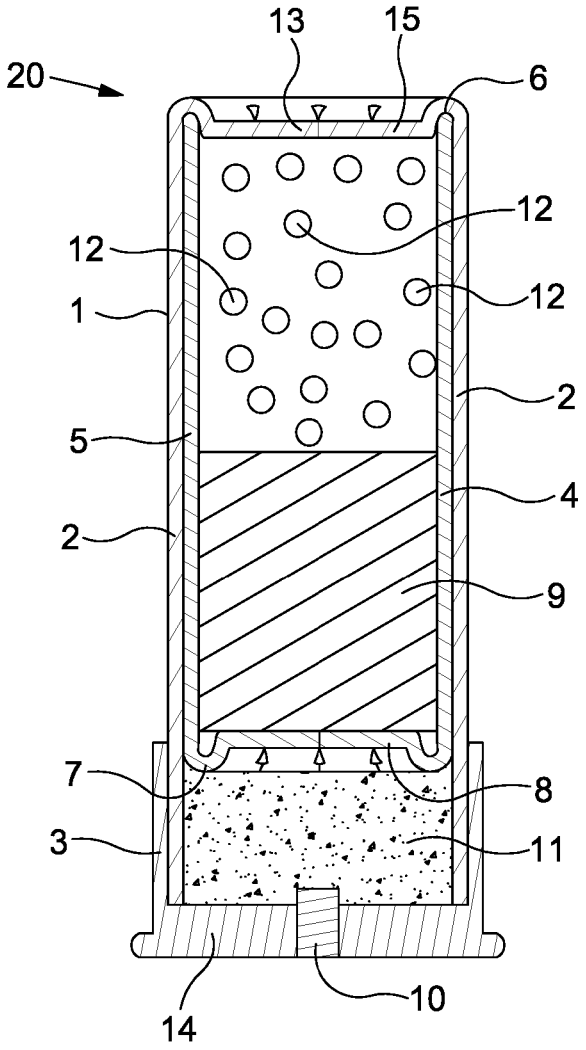
FIG. 7 is a cross-sectional view of a first example of a shotgun cartridge incorporating the wad of FIGS. 2 to 4.

FIG. 7 shows a first example of a shotgun cartridge 20. The cartridge 20 is constructed by inserting a primer 10 into an aperture in the centre of the base 14 of the brass head 3 of the case 1. Gun powder 11 is then introduced into the case 1 so that it is located adjacent to the base 14 and the powder 11 contacts the primer 10.

The cup section 4 is then inserted into the open end 13 of the plastic sleeve 2 of the case 1 and the separation member 9 inserted into the open end 6 of the cup section 4. The cup section 4 is pressed down into the case 1 so that it rests on the gun powder 11, as shown in FIG. 7. The separation member 9 is pushed down inside the cup section 4 until it rests against the crimped folds 8 of the closed end 7 of the cup section 4.

Shot 12 is then inserted into the cup section 4 above the separation member 9 and open end 13 of the case 1 is then closed by crimping the open end of the plastic sleeve 2 over the open end 6 of the cup section 4 and across the top of the shot 12 to form a folded crimp closure 15.

In use the shotgun cartridge 20 is used in the same way as a conventional shotgun cartridge. When the shotgun is fired, the firing pin of the shotgun strikes the primer 10 which causes ignition of the gun powder 11. Ignition of the gun powder 11 generates explosive gases that compress between the base 14 and the closed end 7 of the cup section 4. These gases create the required pressure to propel the wad (comprising the cup section 4 and the separation member 9) together with the shot 12 out of the cartridge 20 by pushing the cup section 4 through the folded crimp 15 and out of the barrel of the gun towards the target.

An advantage of the separation member 9 is that it helps to provide additional structural strength or support to the cup section 4, particularly at the closed end 7 of the cup section 4. The separation member 9 also acts as a barrier between the closed end 7 and the projectile 12 located in the cup section 4 above the separation member 9. The separation member 9 can also provide some shock absorption between the explosive gases generated by the powder 11 in the cartridge 20 and the projectile 12.

After exiting the barrel of the gun, the shot 12 continues to fly towards the target but air resistance on the wad and the relatively light weight of the wad (which consists of the cup section 4 and the separation member 9) results in the wad separating from the shot and falling to the ground some distance from the gun.

An advantage of the wad of the invention is that as the cup section 4 and the separation member 9 are formed from natural materials that are biodegradable, they naturally breakdown into the ground over time to have a reduced environmental impact compared to conventional plastic wads.

Figure 8:
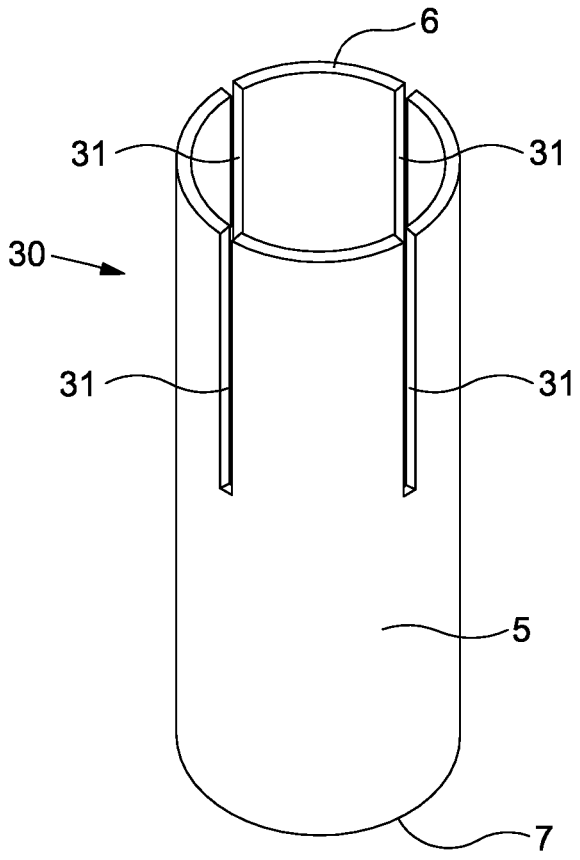
FIG. 8 is a second example of a cup section of a wad in accordance with the invention.

FIG. 8 shows a second example of a cup section 30. As the cup section 30 is very similar to the cup section 4, so the same reference numerals have been used on the cup section 30 to indicate the same parts as for the cup section 4. The only difference between the cup section 30 and the cup section 4, is that the cup section 30 has four slots 31 formed in its upper end adjacent to open end 6 of the cup 30.

Figure 9:
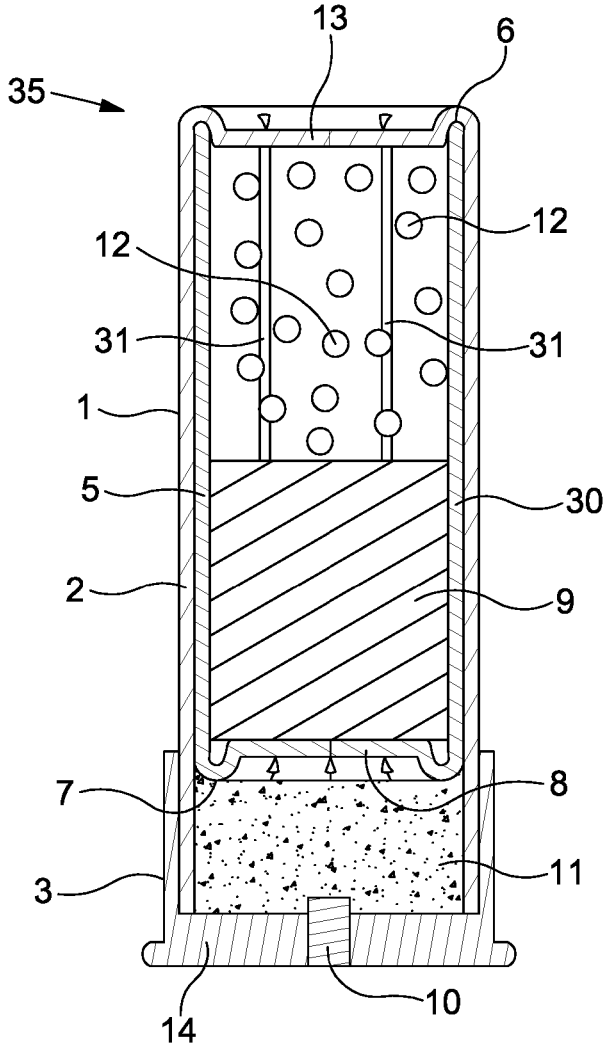
FIG. 9 is a cross sectional view of a second example of a shotgun cartridge incorporating the second example of the cup section of the wad.

FIG. 9 shows a cross-sectional view of a second shotgun cartridge 35 which is identical to the shotgun cartridge 20 except that the cup section 4 is replaced with the cup section 30. Accordingly, the same reference numerals have been used in FIG. 9 to indicate the parts of the shotgun cartridge 35 that are the same as the shotgun cartridge 20. Preferably, the size of the slots 31 is such that the width of the slots is less than the diameter of the shot 12. Typically, the slots 31 have a width of approximately 1 mm. This minimises the risk of the shot 12 passing through the slots 31.

In the cup section 30, the slots 31 extend from the open end 6 of the cup 30 to approximately adjacent the upper end of the plug section 9 in the cup 30. That is, the end of the plug section 9 that is opposite the closed end 7 of the cup section 30. However, slots of difference length could be used as desired and it is possible that the slots 31 may not necessarily extend all the way to the open end 6. The slots 31 extend substantially parallel to the longitudinal axis of the cylindrical tube 5.

An advantage of the cup section 30 and the slots 31 is that the slots 31 permit the side walls of the cup section 30 to compress if necessary, to facilitate easier exit of the cup section 30, containing the separation member 9 and the shot 12 from the case 1 and the barrel of the gun, and particularly through the choke at the end of the barrel.

Figure 10:
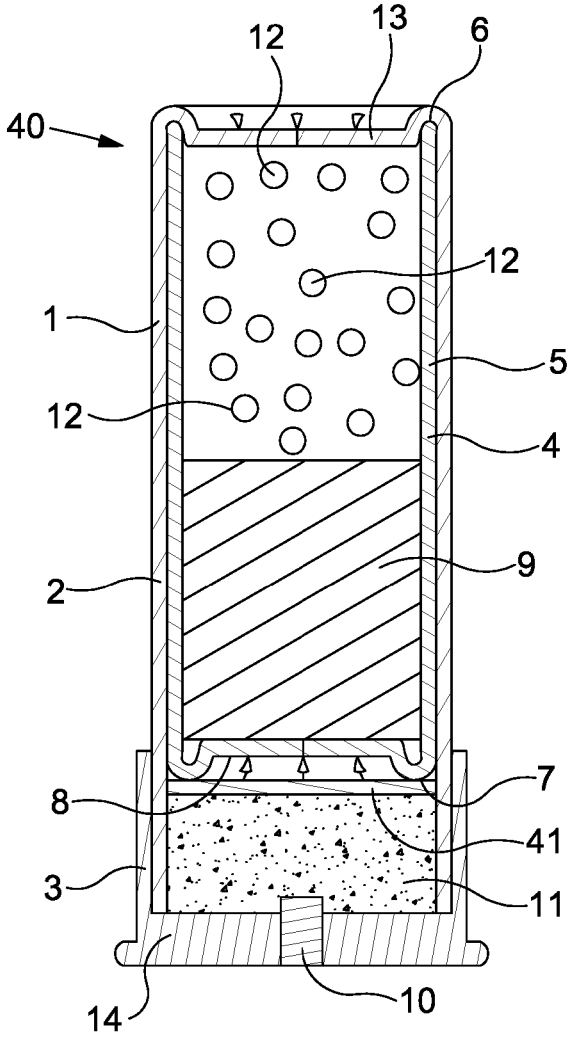
FIG. 10 is a cross-sectional view of a third example of a shotgun cartridge incorporating a barrier member between the powder and the cup section of the wad.

FIG. 10 shows a third example of a shotgun cartridge 40. The shotgun cartridge 40 is identical to the shotgun cartridge 20 except for the addition of a barrier member 41 between the closed end 7 of the cup section 4 and the gun powder 11. Accordingly, the same reference numerals have been used in FIG. 10 to indicate the parts of the shotgun cartridge 40 that are the same as the shotgun cartridge 20.

The barrier member 41 is approximately disc shaped and extends across the internal diameter of the plastic sleeve 2. Hence the barrier member 41 separates the powder 11 from the cup section 4 and helps to minimise or prevent contact between the powder 11 and the cup section 4.

The advantage of the barrier member 41 is that it helps to minimise the impact of the explosive gases, created by ignition of the powder 11, on the closed end 7 of the cup section 4 by providing a barrier which helps to protect the closed end 7. Typically, the barrier member 41 is also manufactured from a biodegradable material and that is preferably a naturally occurring material. This may be the same or a similar material to the material from which the separation member 9 is manufactured.

For example, the barrier member 41 could be formed from any suitable biodegradable material, and preferably a biodegradable fibrous material. The biodegradable material may be composed of natural (as opposed to synthetic or man-made) materials, such as natural fibres. For example, the biodegradable material may comprise at least one of a cellulose based fibrous material and a protein based fibrous material. Examples of cellulose based fibrous materials include cotton, flax and cardboard. Examples of protein based fibrous materials include wool, hair, fur and silk. Cellulose based fibrous materials may be formed from a pulp, such as a wood-based or a plant-based pulp. The biodegradable fibrous material may be a compressed fibrous material, such as compressed cellulose based fibres (such as cotton fibres, flax fibres, wood-based pulp or plant based pulp) and/or compressed protein based fibres (such as wool, fur or hair). In one example, the biodegradable fibrous material could be formed from a felt material.

In use, the barrier member 41 is propelled out of the case 1 and the barrel of the gun together with the wad (comprising the cup section 4 and the separation member 9) and the shot 5, in a similar manner to how the wad and shot is propelled out of the shotgun cartridges 20, 35.

Figure 11:
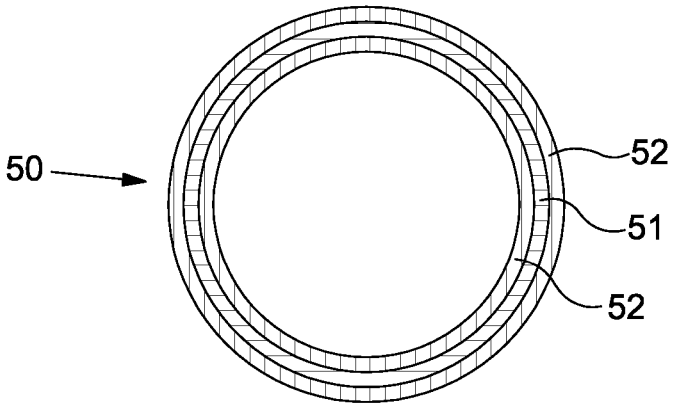
FIG. 11 is a cross-sectional view of a third example of a cup section.

FIG. 11 is a cross-sectional view of a third example of a cup section 50. The cup section 50 is similar to the cup section 4 except that instead of being formed wholly from wood pulp, the cup section 50 is formed from a layer of fabric material 51 sandwiched between two layers of wood pulp material 52, 53. The layers 51, 52, 53 are typically laminated together. The fabric material may be a woven or a knitted material. The fabric material forming the layer 51 is typically biodegradable. For example, the fabric material could be formed from any naturally occurring fibrous material, such plant-based fibrous material or protein-based fibrous material or any suitable combination of different fibrous materials, such as a blend of different fibrous materials. Examples of suitable fabric materials include woven linen, cotton, hemp, jute, wool and silk.

It is also possible that the cup section 50 could be modified to include more than three layers. For example, it could comprise five layers having three layers of wood pulp material and two layers of fabric material arranged so that each fabric material layer is are located between two layers of wood pulp material. It is also possible that a layer of wood pulp material could be sandwiched between two fabric material layers.

Figure 12:
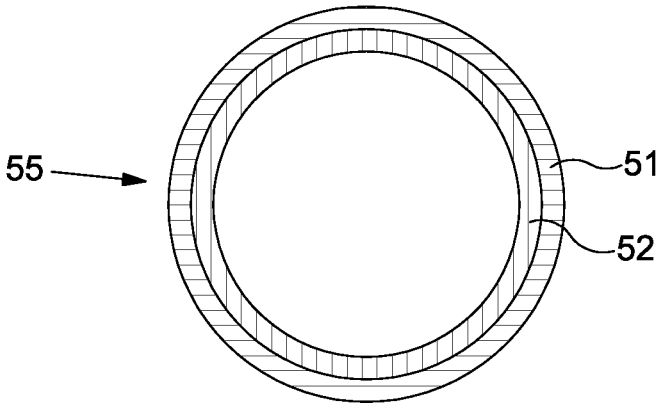
FIG. 12 is a cross-sectional vies of fourth example of a cup section.

FIG. 12 is a cross-sectional view of a fourth example of a cup section 55. The cup section 55 is similar to the cup section 4 except that instead of being formed wholly from wood pulp, the cup section 55 is formed from an inner layer of wood pulp material 52 with a layer of fabric material 51 laminated to the outside of the wood pulp material layer 52.

The cup section 55 could be modified to include more than two layers. For example, it could comprise four layers having two layers of wood pulp material and two layers of fabric material arranged so that layers of fabric material alternate with the layers of wood pulp material, so that the innermost layer is a wood pulp material layer.

Figure 13:
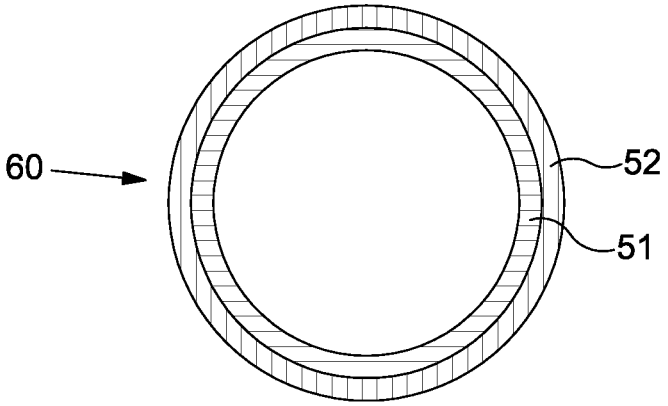
FIG. 13 is a cross-sectional view of a fifth example of a cup section.

FIG. 13 is a cross-sectional view of a fifth example of a cup section 60. The cup section 60 is similar to the cup section 4 except that instead of being formed wholly from wood pulp, the cup section 60 is formed from an outer layer of wood pulp material 52 with a layer of fabric material 51 laminated to the inside of the wood pulp material layer 52.

The cup section 60 could be modified to include more than two layers. For example, it could comprise four layers having two layers of wood pulp material and two layers of fabric material arranged so that layers of fabric material alternate with the layers of wood pulp material with the outermost layer being a wood pulp material layer.

Figure 14:
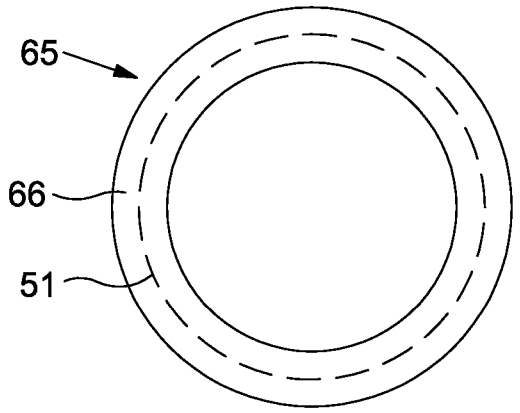
FIG. 14 is a cross-sectional view of a sixth example of a cup section.

FIG. 14 is a cross-sectional view of a sixth example of a cup section 65. In the cup section 65, as an alternative to the fabric material 51 being laminated to the wood pulp layer or sandwiched between two wood pulp layers as shown in FIGS. 11 to 13, a fabric material 67 (indicated in phantom in FIG. 14) is entrapped or embedded into the body of wood pulp material 66 during a manufacturing process, such as a molding process. For example, if the cup section 65 is formed from a molded pulp, the fabric material 67 could be incorporated into the wood pulp material 66 during the molding process. This may possibly have the advantage of increasing the strength of the cup section 65 as in the finished cup section 65 the wood pulp material 66 may penetrate the fabric material 67. It is also possible that a cup section could be formed by a combination of a sandwich construction of at least one fabric material layer 51 and at least one wood pulp layer 52 with a fabric material 67 entrapped or embedded into at least one of the wood pulp layers. In this case the wood pulp layer 52 would be similar to the cup section 65 with the fabric material 67 entrapped or embedded within the wood pulp material 66.

Any of the cup sections 50, 55, 60, 65 or any of the alternative or modified cup sections described above could also incorporate slots similar to the slots 31 in the cup section 30.

An advantage of the wad used in the shotgun cartridges 20, 35, 40 is that it is composed of biodegradable material, such as natural fibres, thereby reducing the impact of the wad 4, 9, 30, 41 on the environment compared to conventional plastic wads.

The invention claimed is:

1. A wad for a shotgun cartridge, the wad comprising a cup-shaped member having an open end and closed end, and wherein the cup-shaped member comprises a first biodegradable fibrous material, wherein the cup-shaped member comprises at least one of: (i) a fabric material laminated onto a pulp material; and (ii) a fabric material embedded into a pulp material.

2. A wad according to claim 1, wherein the first biodegradable fibrous material is a natural fibrous material.

3. A wad according to claim 1, wherein the cup-shaped member is formed at least in part from a pulp material.

4. A wad according to claim 1, further comprising a separation member located inside the cup-shaped member adjacent the closed end of the cup-shaped member, and wherein the separation member comprises a second biodegradable fibrous material.

5. A wad according to claim 4, wherein the second biodegradable fibrous material is a natural fibrous material.

6. A wad according to claim 4, wherein the separation member is formed at least in part from at least one of a pulp material and a felt material.

7. A wad according to claim 4, wherein the second biodegradable fibrous material is a compressed biodegradable fibrous material.

8. A wad according to claim 1, wherein the cup-shaped member is formed from a tubular member that is crimped at one end to form the closed end.

9. A wad according to claim 1, wherein side walls of the cup-shaped member have at least one slit extending from adjacent the open end to at least part way along the side wall towards the closed end.

10. A wad according to claim 9, wherein opposite sides of the slit are spaced apart from each other so that the slit forms a slot.

11. A wad according to claim 9, wherein the end of the at least one slit closest to the closed end is spaced from the closed end.

12. A wad according to claim 1, wherein the cup-shaped member comprises a friction reducing outer surface.

13. A shotgun cartridge comprising an outer casing, the casing containing a primer located in a base of the casing, an explosive powder adjacent the base of the casing and the primer, a wad comprising a cup-shaped member located on the opposite side of the powder from the base and a projectile located within the cup-shaped member; and wherein the cup-shaped member comprises a first biodegradable fibrous material, wherein the cup-shaped member comprises at least one of: (i) a fabric material laminated onto a pulp material; and (ii) a fabric material embedded into a pulp material.

14. A shotgun cartridge according to claim 13, wherein the wad further comprises a separation member located within the cup-shaped member, and the separation member comprises a second biodegradable fibrous material.

15. A shotgun cartridge according to claim 14, wherein the separation member is located between a closed end of the cup-shaped member and the projectile.

16. A shotgun cartridge according to claim 13, wherein the cup-shaped member comprises a tube having a crimped closure at one end.

17. A shotgun cartridge according to claim 13, wherein the wad further comprises a disc-shaped member located between the explosive powder and the cup-shaped member.

18. A shotgun cartridge according to claim 13, wherein the cup-shaped member comprises at least one slit extending from adjacent an open end of the cup-shaped member at least part way along the side wall towards the closed end.

* * * * *